US005937776A

United States Patent [19]

Ogawa et al.

[11] Patent Number: 5,937,776

[45] Date of Patent: Aug. 17, 1999

[54] THREAD CUTTING DEVICE OF SEWING MACHINE

[75] Inventors: Tatsuya Ogawa; Mitsuhiro Tachikawa; Atsushi Kudo, all of Tokyo, Japan

[73] Assignee: Juki Corporation, Tokyo, Japan

[21] Appl. No.: 08/854,636

[22] Filed: May 12, 1997

[30] Foreign Application Priority Data

May 11, 1996 [JP] Japan ..... 8-140682

[51] Int. Cl.[6] ..... D05B 65/00

[52] U.S. Cl. ..... 112/292

[58] Field of Search ..... 112/292, 295, 112/298; 81/905, 910, 699.11

[56] References Cited

U.S. PATENT DOCUMENTS 3,532,065 10/1970 Marforio ..... 112/292
4,726,305 2/1988 Seto ..... 112/292 X
5,469,798 11/1995 Gauch ..... 112/298
5,481,994 1/1996 Ku ..... 112/298

FOREIGN PATENT DOCUMENTS 2821193 9/1970 Russian Federation ..... 112/292

*Primary Examiner*—Ismael Izaguirre
*Attorney, Agent, or Firm*—Morgan & Finnegan LLP

[57] ABSTRACT

A thread cutting device of a sewing machine comprises: a movable knife having a thread pickup portion and being movable between a standby position and a thread pickup position; a fixed knife being movable between a standby position and an operating position close to a needle locating point and cutting sewing threads in cooperation with the movable knife at the operating position; a front stopper for holding the fixed knife at the standby position, wherein the front stopper is released from the fixed knife in the course of the movable knife making a forward movement; and a rear stopper for holding the fixed knife at the operating position, wherein the rear stopper is released from the fixed knife in the course of the movable knife making a backward movement and after the sewing threads have been cut.

8 Claims, 8 Drawing Sheets

PRIOR ART (2)

PRIOR ART (3)

PRIOR ART (4)

PRIOR ART (5)

PRIOR ART (2)

PRIOR ART

THREAD CUTTING DEVICE OF SEWING MACHINE

BACKGROUND OF THE INVENTION

The invention relates to a thread cutting device for cutting a needle thread and a bobbin thread after the sewing operation (including zigzag stitching) has been ended with a sewing machine.

Known as a conventional example is a thread cutting device that is disclosed in Unexamined Japanese Utility Model Publication No. Hei. 3-30947 published in Japan before the application of the present invention and that is shown in FIGS. 2(1) to 2(3), 3A(1) to 3B(5), 6, 8(1) to 8(2), 9.

In these figures, a needle hole 26*a* formed in a throat plate 26 of a sewing machine is such a slender, elongated hole as to allow a needle N to be located at left and right positions so as to swing. The thread cutting device is fixed below a slide 32 on one side in the longitudinal direction of the needle hole 26*a*.

This thread cutting device includes a movable knife 21, a fixed knife 22, a stopper 23, and a spring 24.

The movable knife 1 has a blade portion 21*a* formed on the upper surface close to the point thereof, and a thread pickup portion 21*b* for picking up sewing threads Y formed by having the middle portion thereof indented, and can shuttle between a standby position (FIG. 2(1) and FIGS. 3A(1) and 3B(5)) and an advance position (FIG. 2(3) and FIG. 3A(2)).

The fixed knife 22 has a blade portion 22*a* arranged on the front end thereof, and has a stepped portion 22*b* arranged on one side edge of the base end portion thereof. The fixed knife 22 can shuttle between a stop position (FIG. 2(1) and FIG. 3A(1)) and an operating position (FIG. 2(3) and FIGS. 3A(2) to 3A(4)). The blade portion 22*a* of the fixed knife 22 has an acutely angled blade point as shown in FIG. 6.

The stopper 23 has the base end thereof supported so as to be rotatable. The stopper 23 has a stopper portion 23*a* arranged on the front end thereof. The stopper portion 23*a* not only positions and fixes the fixed knife 22 at the operating position while engaged with the stepped portion 22*b*, but also blocks the fixed knife 22 from returning to the stop position when the fixed knife 22 is moving to the operating position thereof. The spring 24 gives the stopper 23 elasticity in the rotating direction so that the stopper 23 can perform the positioning and fixing operation.

An elongated hole 22*c* is formed in the fixed knife 22. The elongated hole 22*c* extends in the moving direction of the fixed knife 22. A projecting portion 25 engageable with the elongated hole 22*c* is formed on the base end of the movable knife 21. The movable knife 21 is coupled to a drive unit to be described later. In the course of the movable knife 21 making a forward movement (FIG. 2(2)), the projecting portion 25 engages with the right end of the elongated hole 22*c* to couple the fixed knife 22 to the movable knife 21, and the movable knife 21 therefore continues to make the forward movement as far as to the advance position (the operating position) together with the fixed knife 22. Further, the movable knife 21 has a cam portion 21*c* formed, the cam portion 21*c* engaging with the stopper 23 and allowing the stopper 23 to move away from the stepped portion 22*b* of the fixed knife 22 when the movable knife 21 is making a backward movement.

An operation of this thread cutting device will be described. In a zigzag sewing machine used in the following description, the thread cutting position (the operating position) with the movable knife 21 and the fixed knife 22 is located at the center in the longitudinal direction of the needle hole 26*a* shown by the one dot chain lines in FIG. 3 independently of needle swinging positions. When a solenoid 27 shown in FIG. 9 has been energized, a drive lever 28 is rotated, so that one end of the drive lever 28 engages with a thread cutting cam 30 fixed to a main shaft 29 of the sewing machine. As the cam surface of the thread cutting cam 30 displaces in accordance with the rotation of the main shaft 29, the drive lever 28 rotates counterclockwise (FIG. 9). An operation lever 32 rotates counterclockwise as viewed in FIG. 9 while pulled by a wire 31 fixed to the other end of the drive lever 29. As a result, a coupling lever 33 coupled to the front end of the operating lever 32 rotates, which in turn causes the movable knife 21 coupled to the coupling lever 33 to make a forward movement from the standby position.

In the course of the movable knife 21 making a forward movement, the fixed knife 22 also makes a forward movement with the projecting portion 25 of the movable knife 21 having engaged with the right end of the elongated hole 22*c* of the fixed knife 22 as shown in FIG. 2(2). In the course of the fixed knife 22 making the forward movement, the front end of the movable knife 21 advances into a loop Y1*a* of the needle thread Y1 that is picked up by a beak of a rotary hook portion (not shown) (FIG. 3A(1)).

When the movable knife 21 is in the advance position (FIG. 2(3), FIG. 3A(2)), the needle thread Y1 extending to the needle N and the bobbin thread Y2 between a piece of work W and the rotary hook portion (not shown) are positioned within the indented portion of the movable knife 21 and caught by the front end of the fixed knife 22. Further, at this position, the stopper 23 locks the fixed knife 22 while engaged with the stepped portion 22*b* of the fixed knife 22.

When the movable knife 21 makes a backward movement, the pickup portion 21*b* picks up the needle thread Y1 within the indented portion and the bobbin thread Y2 (FIG. 3A(3)). When the blade portion 21*a* of the movable knife 21 has returned to a position where the blade portion 22*a* of the fixed knife 22 is located (FIG. 3B(4)), the blade portions 21*a*, 22*a* of the movable knife 21 and the fixed knife 22 coincide with each other. As a result, the needle thread Y1 and the bobbin thread Y2 are cut.

As the movable knife 21 thereafter continues to return, not only the cam portion 21*c* of the movable knife 21 releases the stopper 21 from the stepped portion 22*b* while pushing the stopper 21 away, but also the projecting portion 25 of the movable knife 21 engages with the left end of the elongated hole 22*c* of the fixed knife 22. As a result, the fixed knife 22 is caused to return to the standby position together with the movable knife 21 (FIG. 3B(5)).

In the thus constructed conventional thread cutting device, the projecting portion 25 of the movable knife 21 engages with the right end of the elongated hole 22 of the fixed knife 22 so as to allow the fixed knife 22 to follow the movable knife 21 while the movable knife 21 is making a forward movement, and the movable knife 21 and the fixed knife 22 are brought into pressure contact with each other so that threads can be cut with both knives operating in cooperation with each other. As a result, the fixed knife 22 has sometimes been allowed to follow the movable knife 21 disadvantageously by the pressure applied to both knives before the projecting portion 25 engages with the elongated hole 22*c* while the movable knife 21 is making an initial forward movement. Consequently, the fixed knife 22 destroys the shape of a needle thread loop Y1*a* while coming in contact with the needle thread loop Y1*a* before the movable knife 21 advances into the needle thread loop Y1*a*. This prevents the movable knife 21 from spreading the needle thread loop while advancing into the loop and therefore prevents the cutting of the threads. Further, not only a needle thread portion extending to the needle, but also a needle thread portion extending to the fabric have been picked up together and cut.

Further, when the fixed knife 22 unexpectedly follows the movable knife 21 as described above, the blade portion 22*a* of the fixed knife 22 may cut the needle thread Y1 or the bobbin thread Y2 accidentally.

Still further, the blade portion 22*a* of the fixed knife 22 has, in some cases, cut the needle thread Y1 and the bobbin thread Y2 before the blade portion 22*a* engages with the blade portion 21*a* of the movable knife 21 due to the pressure applied to both knives when the pickup portion 21*b* picks up and pulls the needle thread Y1 and the bobbin thread Y2 while the movable knife 21 is making a backward movement (FIG. 8(2)). In this case, the distance between the cutting position and the pickup portion 21*b* becomes L2, unlike the distance during the normal thread cutting, which is L1 (FIG. 8(1)). Therefore, the following problems have been addressed. The lengths of the cut needle thread extending to the needle and the cut bobbin thread extending to the fabric become short, and this causes the needle thread to come off from the needle, opens up the finishing seams, and causes initial stitches to skip when a next sewing operation is performed, etc.

SUMMARY OF THE INVENTION

The object of the invention is to provide a thread cutting device of a sewing machine which can perform a normal thread cutting operation at all times.

A thread cutting device of a sewing machine of the invention includes: a movable knife having a thread pickup portion and movable between a standby position and a thread pickup position; a fixed knife movable between a standby position and an operating position close to a needle locating point and cutting sewing threads in cooperation with the movable knife at the operating position; a front stopper for holding the fixed knife at the standby position; and a rear stopper for holding the fixed knife at the operating position. The thread cutting device of a sewing machine of the invention also has cam portions arranged on the movable knife, the cam portion serving to release the fixed knife from the front stopper in the course of the movable knife making a forward movement, the cam portion serving to release the fixed knife from the rear stopper at the time the movable knife makes a backward movement after the sewing threads have been cut.

It is so designed that the fixed knife is released from the front stopper after the movable knife has effected loop spreading.

It is so designed that the movable knife, the fixed knife, and the respective stoppers are interposed between a thread cutting device table and a slide.

It is so designed that an upper portion of a blade point of the fixed knife is formed into a smoothly projecting portion projecting frontward from a blade point position.

DETAILED DESCRIPTION OF THE PREFERRED EMBODIMENTS

A thread cutting device of a sewing machine, which is one mode of embodiment of the invention will now be described with reference to FIGS. 1A(1) to 1*b*(5), 4, 5, and 7.

Figure 5:
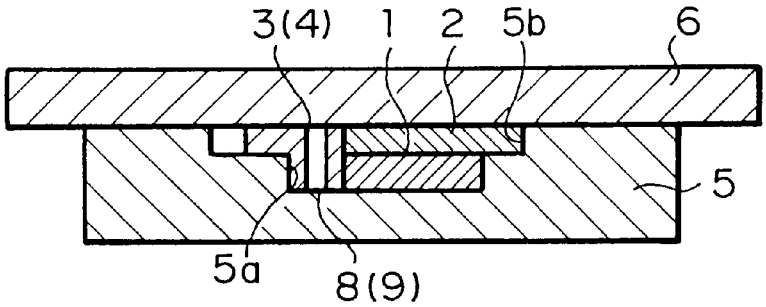
FIG. 5 is a side sectional view illustrative of how respective members of the thread cutting device of the invention is assembled.
Figure 6:
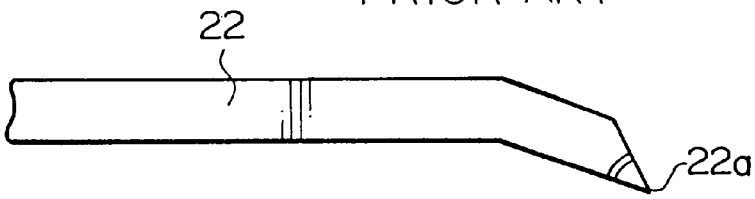
FIG.6 PRIOR ART
FIG. 6 is a front view of a fixed knife forming the conventional thread cutting device.

Similar to the conventional example, the thread cutting device of a sewing machine of the invention is disposed below a slide 6 so as to be flanked by a throat plate (not shown). The thread cutting device mainly includes a movable knife 1, a fixed knife 2, a front stopper 3, and a rear stopper 4. As shown in FIG. 5, the movable knife 1 is accommodated in a groove 5*a* of the thread cutting device table 5 so as to be slidable. The fixed knife 2 is accommodated in a groove 5*b* so as to be slidable while superposed on the upper side of the movable knife 1 in the groove 5*a*. The front stopper 3 and the rear stopper 4 are accommodated side by side so as to be flanked by the movable knife 1 in the groove 5*a* and the fixed knife 2 in the groove 5*b*. The slide 6 is arranged so as to cover these members.

On the upper surface close to the point of the movable knife 1 is a blade portion 1*a*. In the middle is a thread pickup portion 1*b* for picking up a sewing thread. A pin 7 is arranged so as to project from the base end portion of the movable knife 1. The movable knife 1 can shuttle between a standby position (FIG. 1A(1)) and a thread pickup position (FIG. 1A(3)) while coupled to a not shown drive means similar to that of the conventional example.

Figure 7:
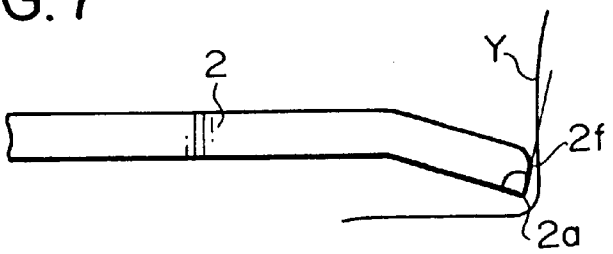
FIGS. 7(1) and 7(2) are front views of exemplary fixed knives forming the thread cutting device of the invention.
Figure 7:
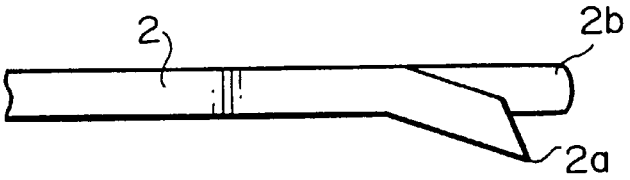
Figure 8:
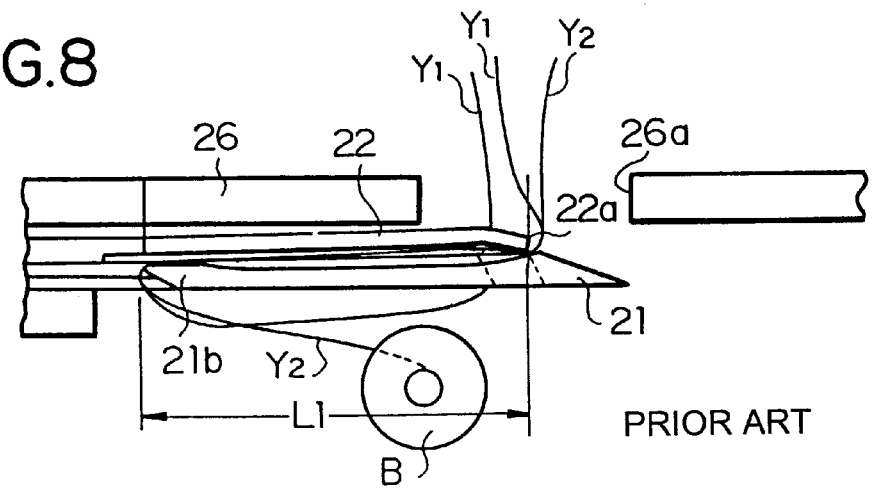
FIGS. 8(1) and 8(2) are front views illustrative of thread cutting conditions with the conventional thread cutting device: 8(1) A condition in which a thread is cut regularly; 8(2) a condition in which a thread is cut erroneously.
Figure 8:
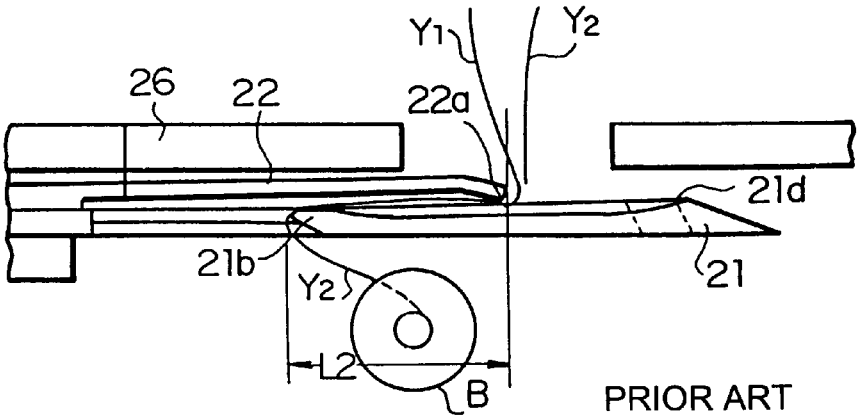
Figure 9:
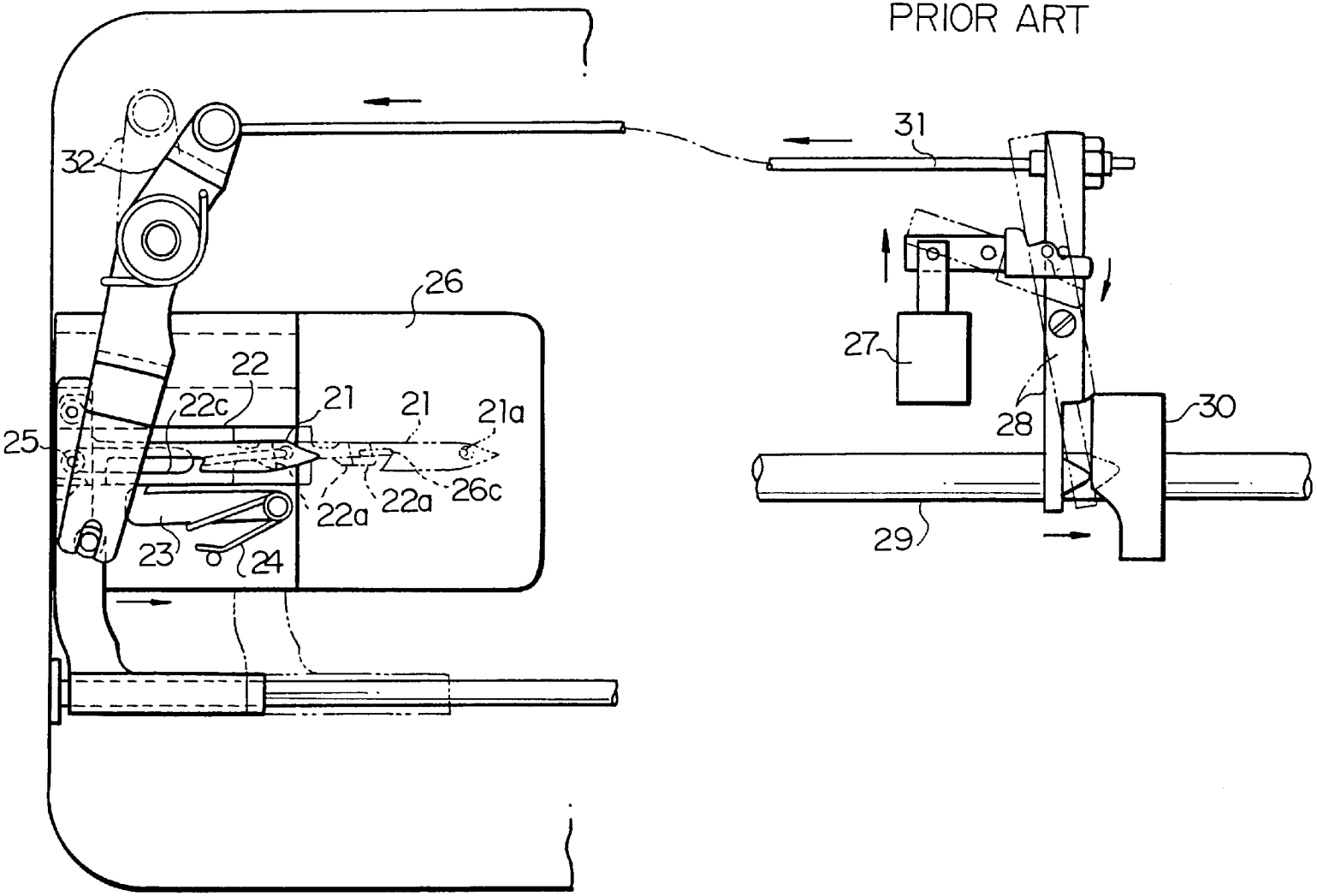
FIG. 9 PRIOR ART
FIG. 9 is a plan view showing a drive mechanism of the conventional thread cutting device.

As shown in FIG. 7(1), a blade portion 2*a* is arranged on the point of the fixed knife 2. A corner edge of the blade portion is not pointed unlike that in the conventional example. That is, the corner edge is right-angled or slightly wider-angled than the right angle (obtuse-angled). However, since an excessively large angle impairs cutting performance, the angle is set to such a value as to allow a thread to be cut properly. Further, an upper corner portion 2*f* is not pointed, either, i.e., rounded or chamfered. It may be noted that a smoothly projecting portion 2*b* is formed on the upper part of the conventional acute-angled point, the smoothly projecting portion 2*b* projecting frontward from the acute-angled point position as shown in FIG. 7(2). At any rate, it is so designed that a sewing thread Y is prevented from coming in contact with the blade point before the normal cutting operation is performed.

In the base end portion of the fixed knife 2 is an elongated hole 2*c* that extends along the length of the knife. The pin 7 of the movable knife 1 engages with the elongated hole 2*c*. The right end of the elongated hole 2*c* comes in contact with the pin 7 when the front stopper 3 is released from a catching stepped portion 2*d* of the fixed knife 2 by a cam portion 1*c* to be described later acting on the free end of the front stopper 3 during the forward movement of the movable knife 1. The left end of the elongated hole 2*c* comes in contact with the pin 7 when the rear stopper 4 is released from a catching stepped portion 2*e* of the fixed knife 2 by a cam portion 1*d* to be described later acting on the free end of the rear stopper 4 during the backward movement of the movable knife 1.

The front stopper 3 fixes the fixed knife 2 at the standby position until the movable knife 1 completely advances into a needle thread loop, whereas the rear stopper 4 not only positions and fixes the fixed knife 2 at the operating position but also prohibits movement thereof to the standby position.

Figure 4:
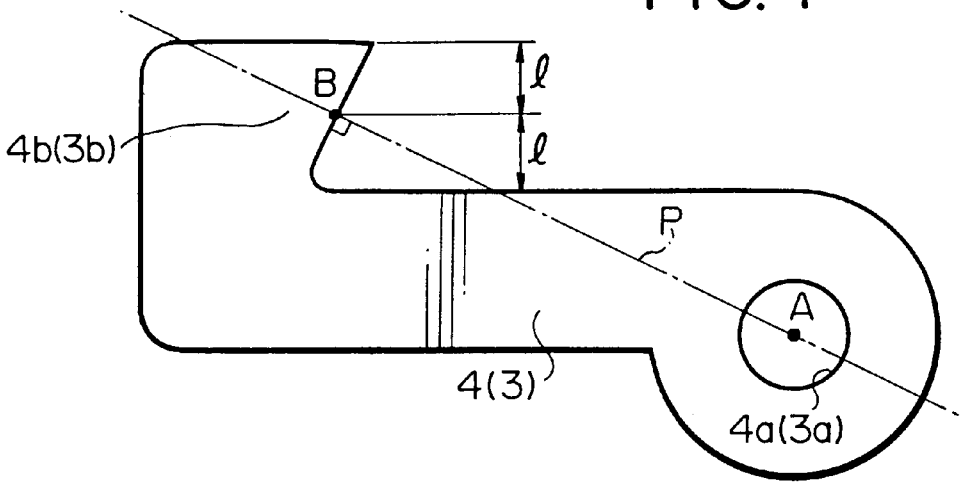
FIG. 4 is a plan view of a stopper forming the thread cutting device of the invention.

Each of the front stopper 3 and the rear stopper 4 is constructed of a small plate body having such a shape as shown in FIG. 4. The front stopper 3 is reversed from the condition shown in FIG. 4 when it is in a set position. A small hole 4*a* (3*a*) is formed in one end of each stopper 4 (3) so that a shaft 9 (8) can pass therethrough. In the other end thereof is a latch portion 4*b* (3*b*). The catching surface of the latch portion 4*b* (3*b*) is inclined at such an angle as to be perpendicular to a line connecting the center A of the small hole 4*a* (3*a*) to the center B of the catching surface or at a larger angle so that engagement of the fixed knife 2 with the catching stepped portion 2*d* (2*c*) to be described later can be reinforced.

The front stopper 3 and the rear stopper 4 are oscillatably supported by the shafts 8, 9 passing through the small holes 3*a*, 4*a* on the table 5 with the small holes 3*a*, 4*a* confronting each other on one side of the movable knife 1 and the fixed knife 2 accommodated in the grooves 5*a* and 5*b* of the thread cutting device table 5. Further, the free end (the latch portions 3*b*, 4*b*) sides of these stoppers 3, 4 are urged by a stopper spring 10 so as to turn toward the movable knife 1 and the fixed knife 2. The stopper spring 10 has the center thereof supported by a pin 11 that erects on the table 5.

Further, the cam portion 1*c* is formed on the movable knife 1 at a position that is closer toward the rear side than the center and that faces the stoppers 3, 4. The cam portion 1*c* releases engagement of the front stopper 3 with the fixed knife 2 by operating the free end of the front stopper 3 during the forward movement. The cam portion 1*d* is likewise formed on the rear side so that the cam portion 1*d* releases engagement of the rear stopper 4 with the fixed knife 2 by operating on the free end of the rear stopper 4 during the backward movement after the sewing threads have been cut.

Further, the catching stepped portions 2*d*, 2*e* respectively engageable with the latch portion 3*b* of the front stopper 3 and the latch portion 4*b* of the rear stopper 4 are formed at positions closer toward the front side and at the rear end of the fixed knife 2.

In the thus constructed thread cutting device of a sewing machine, a needle thread Y1 and a bobbin thread Y2 are cut in the following operation sequence after the sewing operation has been ended.

Figure 1A:
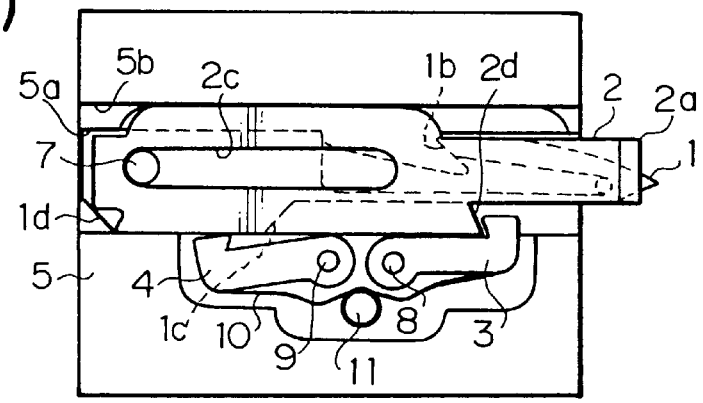
FIGS. 1A(1) to 1A(3) and 1B(4) to 1B(5) are plan views illustrative of a thread cutting operation of a thread cutting device of the invention.
Figure 1A:
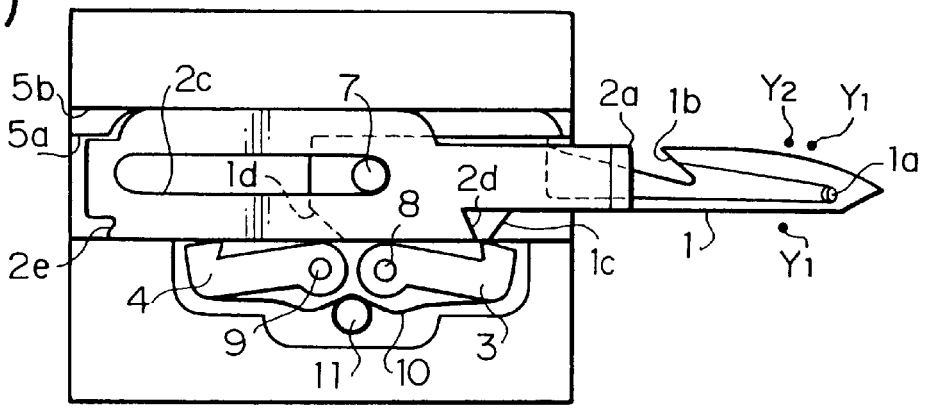
Figure 1A:
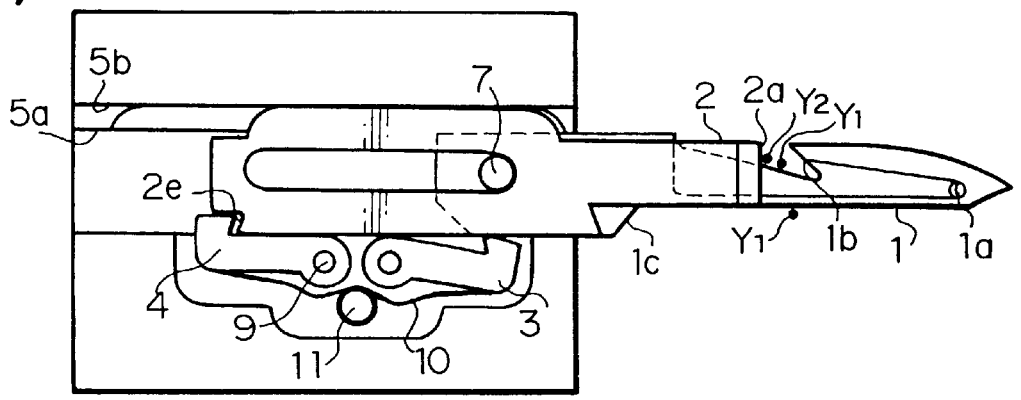
Figure 3A:
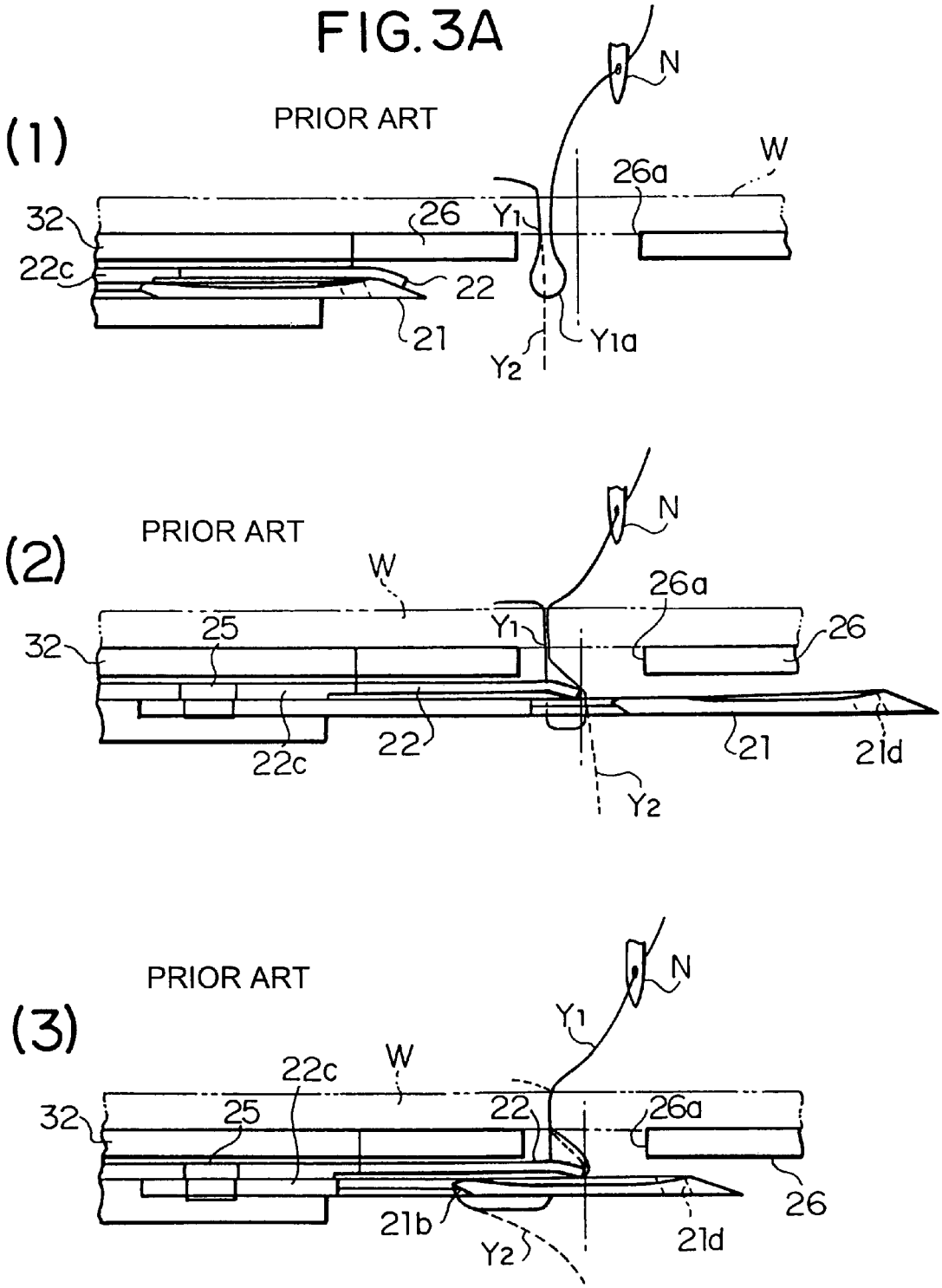
FIGS. 3A(1) to 3A(3) and 3B(4) to 3B(5) are front views illustrative of the thread cutting operation of the conventional thread cutting device.
Figure 3B:
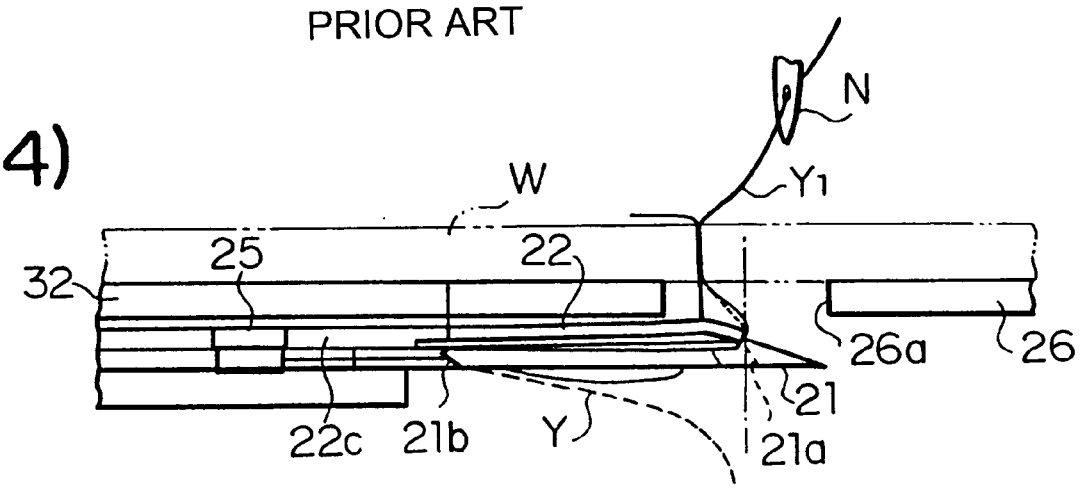
FIG.3B PRIOR ART
Figure 3B:
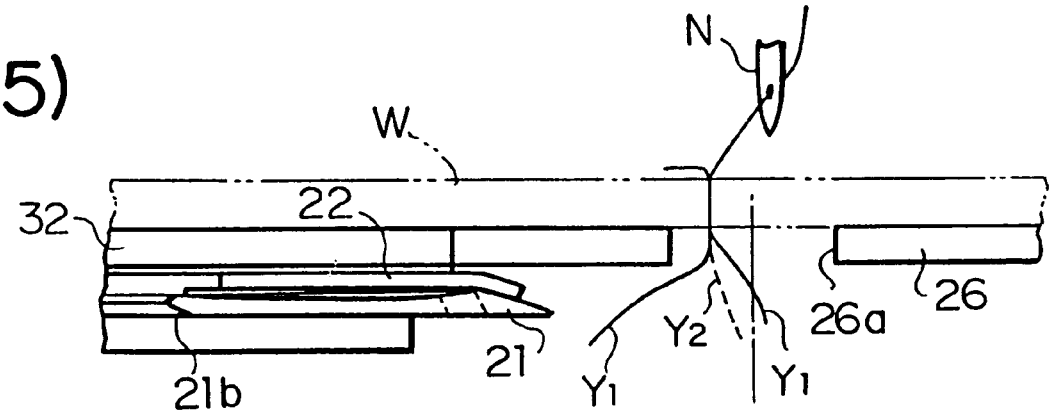
FIG.3B PRIOR ART

The movable knife 1 makes a forward movement from the standby position (FIG. 1A(1)) while driven by the drive means as in the conventional example as shown in FIG. 1A(2), and loop spreading is effected during this process. That is, similarly to the conventional example shown in FIG. 3, the movable knife 1 advances into the loop of the needle thread. However, the fixed knife 2 is locked at the initial position until the movable knife 1 reaches the position shown in FIG. 1A(2) since the fixed knife 2 has the catching stepped portion 2*d* thereof engaged with the front stopper 3.

When the movable knife 1 has arrived at the position shown in FIG. 1A(2) after having advanced into the loop of the needle thread, the cam portion 1*c* of the movable knife 1 operates on the front stopper 3, which in turn unlocks the fixed knife 2. When the movable knife 1 has further advanced to the position shown in FIG. 1A(3), the pin 7 of the movable knife 1 engages with the right end of the elongated hole 2*c* of the fixed knife 2, and the fixed knife 2 also further advances so as to follow the movable knife 1, so that the rear stopper 4 engages with the catching stepped portion 2*e* to thereby lock the fixed knife 2. The blade portion 2*a* of the fixed knife 2 at this time is positioned at the needle swinging center for zigzag stitches (at the center in the longitudinal direction of the elongated hole). Further, the needle thread and the bobbin thread are caught by the blade portion 2*a* of the fixed knife 2.

Figure 1B:
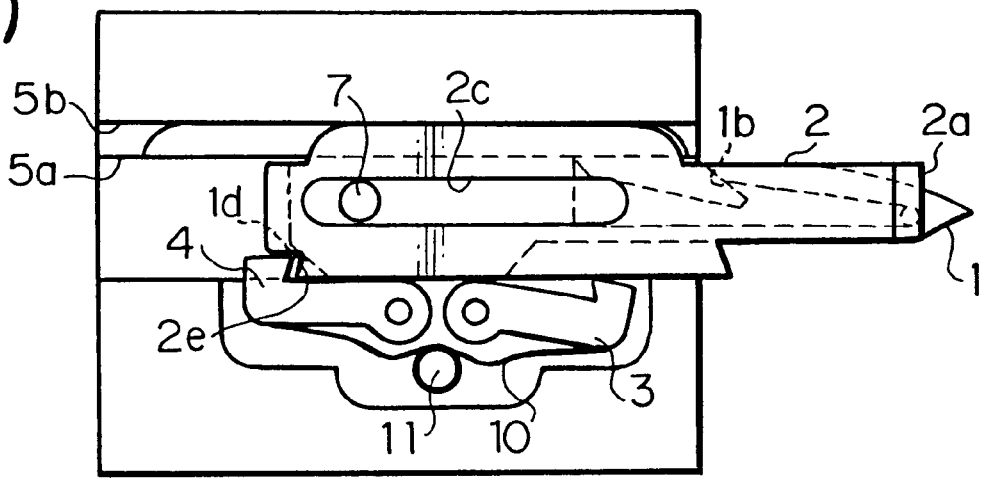
Figure 1B:
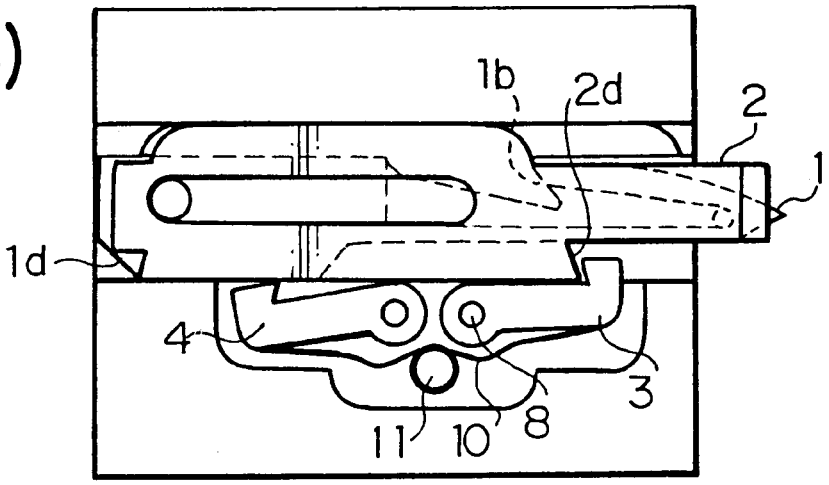

Then, during the backward movement of the movable knife 1 toward a position shown in FIG. 1B(4), the needle thread Y1 and the bobbin thread Y2 are picked up by the thread pickup portion 1*b*. When the movable knife 1 has been brought to a position shown in FIG. 1B(4), the blade portion 2*a* of the fixed knife 2 coincides with the blade surface la of the movable knife 1, and the needle thread and the bobbin thread are cut in association with the backward movement of the movable knife 1. When the cam portion 1*d* of the movable knife 1 making the backward movement operates on the rear stopper 4, the catching stepped portion 2*e* of the fixed knife 2 is released from the rear stopper 4, and the pin 7 of the movable knife 1 engages with the left end of the elongated hole 2*c* of the fixed knife 2. As a result, the fixed knife 2 also returns to a position shown in FIG. 1B(5) together with the movable knife 1. At the same time, the front stopper 3 engages with the catching stepped portion 2*d* of the fixed knife 2, so that the fixed knife 2 is locked to get ready for a next thread cutting operation.

Further, when the movable knife 1 makes a backward movement to bring itself to the condition shown in FIG. 1B(4) from the condition shown in FIG. 1A(3), the sewing threads (the needle thread and the bobbin thread) Y are brought to a regular thread cutting position without receiving excessive Icontact pressure at the rounded or chamfered portion 2*f* or projecting portion 2*b* of the fixed knife 2 as shown in FIG. 7.

Since the invention is constructed as described above, the following advantages can be provided.

Figure 2:
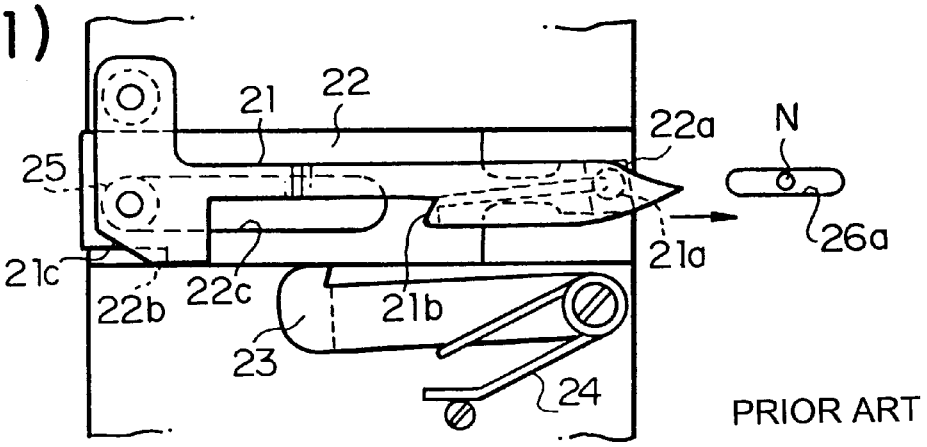
FIGS. 2(1) to 2(3) are bottom views illustrative of a thread cutting operation of a conventional thread cutting device.
Figure 2:
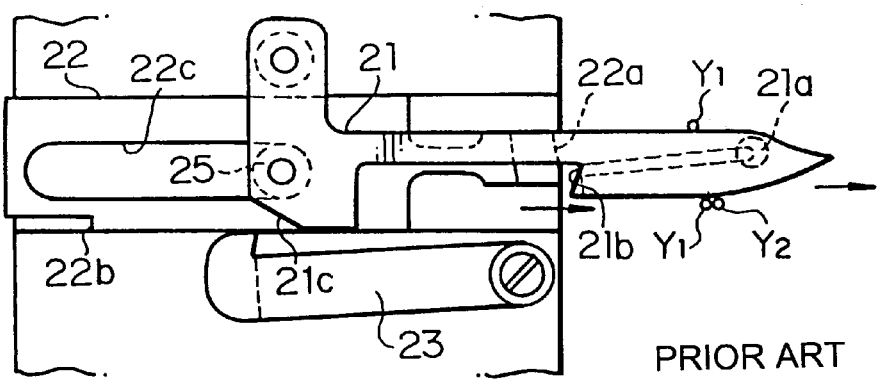
Figure 2:
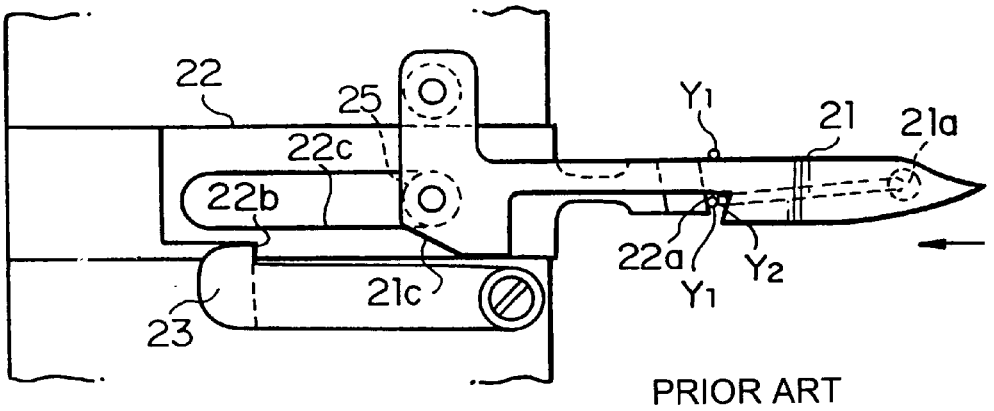

That is, the fixed knife is held in the standby position until the movable knife effects loop spreading. Therefore, defective thread cutting is eliminated. Further, the basic components of the thread cutting device are interposed between the thread cutting device table and the shuttle race slide. Therefore, the basic components no longer come off, which in turn allows members such as guide members (shafts, plates) for the movable knife and the like and release preventing members (the spring shown in FIG. 2(1)) and the like to be dispensed with and contributes to controlling the cost of manufacture under a low level.

Further, the smoothly projecting portion is formed on the upper portion of the blade point of the fixed knife. Therefore, the lengths of the cut needle thread and the cut bobbin thread that extends from the bobbin can be made constant independent of the magnitudes of the amount of bobbin thread wound around the bobbin, the amount of oil in the rotary hook portion, the tension of the bobbin thread, and the like.

As a result, the coming off of the needle thread from the needle at the sewing end, and stitch skipping and thread cast-off at the sewing start can be eliminated. Hence, neatly finished sewn products can be obtained.

What is claimed is:

1. A thread cutting device of a sewing machine comprising:

a movable knife having a thread pickup portion and being movable between a standby position and a thread pickup position;

a fixed knife being movable between a standby position and an operating position close to a needle locating point and cutting sewing threads in cooperation with the movable knife at the operating position;

a front stopper for holding the fixed knife at the standby position, wherein the front stopper is released from the fixed knife in the course of the movable knife making a forward movement; and a rear stopper for holding the fixed knife at the operating position, wherein the rear stopper is released from the fixed knife in the course of the movable knife making a backward movement and after the sewing threads have been cut.

2. The thread cutting device according to claim 1, wherein the fixed knife is released from the front stopper after the movable knife has effected loop spreading.

3. The thread cutting device according claim 1, wherein the movable knife, the fixed knife, and the respective stoppers are interposed between a thread cutting device table and a slide.

4. The thread cutting device according to claim 1, wherein an upper portion of a blade point of the fixed knife is formed into a smoothly projecting portion projecting frontward from a blade point position.

5. A thread cutting device of a sewing machine comprising:

a movable knife having a thread pickup portion and being movable between a standby position and a thread pickup position;

a fixed knife being movable between a standby position and an operating position close to a needle locating point and cutting sewing threads in cooperation with the movable knife at the operating position;

a front stopper for holding the fixed knife at the standby position;

a rear stopper for holding the fixed knife at the operating position;

a first cam portion provided on the movable knife, for releasing the fixed knife from the front stopper in the course of the movable knife making a forward movement; and a second cam portion provided on the movable knife, for releasing the fixed knife from the rear stopper at the time the movable knife makes a backward movement after the sewing threads have been cut.

6. The thread cutting device according to claim 5, wherein the fixed knife is released from the front stopper after the movable knife has effected loop spreading.

7. The thread cutting device according claim 5, wherein the movable knife, the fixed knife, and the respective stoppers are interposed between a thread cutting device table and a slide.

8. The thread cutting device according to claim 5, wherein an upper portion of a blade point of the fixed knife is formed into a smoothly projecting portion projecting frontward from a blade point position.

* * * * *